United States Patent [19]

Dix

[11] Patent Number: 4,481,859

[45] Date of Patent: Nov. 13, 1984

[54] GATLING GUN CONTROL SYSTEM

[75] Inventor: Joseph Dix, Williston, Vt.

[73] Assignee: General Electric Company, Burlington, Vt.

[21] Appl. No.: 473,419

[22] Filed: Mar. 9, 1983

[51] Int. Cl.[3] ..... F41D 7/00

[52] U.S. Cl. ..... 89/12; 89/135

[58] Field of Search ..... 89/12, 9, 11, 135, 33 R

[56] References Cited

U.S. PATENT DOCUMENTS

| | | | |
|---|---|---|---|
| 3,535,979 | 10/1970 | Ashley et al. | 89/12 X |
| 3,537,353 | 11/1970 | Nelson | 89/135 X |
| 3,733,960 | 5/1973 | Ashley et al. | 89/12 |
| 3,921,499 | 11/1975 | Ginsky | 89/12 |
| 3,967,530 | 7/1976 | Vorgrimler et al. | 89/135 |

*Primary Examiner*—David H. Brown

*Attorney, Agent, or Firm*—Bailin L. Kuch

[57] ABSTRACT

This invention relates to a system for automatically halting the operation of a Gatling gun in the event of a non-fire to preclude the possibility of the non-fire becoming a hangfire with an unlocked breech.

5 Claims, 6 Drawing Figures

GATLING GUN CONTROL SYSTEM

PRIOR ART

The conventional, high rate of fire, Gatling gun has no protection against a hangfire round; i.e., a round which detonates less than promptly after its primer has been impacted by the firing pin or energized by the electrical firing circuit. The Gatling gun continues its rotation, even if a single round does not fire, due to either the external driving force in the case of an externally powered gun, or the high rotating inertia in the case of a self powered gun.

Single barrel, relatively low rate of fire guns, have been provided with protection against a hangfire round as shown in U.S. Pat. No. 3,537,353 issued to R. E. Nelson on Nov. 3, 1970, and in U.S. Pat. No. 3,967,530 issued to L. Vorgrimler et al on Oct. 9, 1973.

SUMMARY OF THE INVENTION

It is an object of this invention to provide a Gatling gun with a means to prevent the firing gun bolt from unlocking in the event of a non-firing round of ammunition.

Another object is to provide a Gatling gun with a means to halt the operation of the gun in the event of a non-firing round of ammunition, and to thereafter permit the operation of the gun.

A feature of this invention is the provision of a means to detect the instant that each gun barrel and respective bolt passes the sear point, means to detect the commencement of recoil due the round having fired, means to determine whether the commencement of recoil has been detected within a predetermined period after passage past the sear point and if not so detected then to operate a brake to halt the rotation of the gun prior to the respective gun bolt unlocking.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

The results or effects of a hangfire are a function of three things: (1) The duration of the hangfire, (2) The firing rate of the gun and, (3) The proximity of personnel or equipment in the area of the hangfire detonation.

Hangfires may be grouped into six categories. These categories are: (1) those rounds that detonate well within the gun front dwell area; (2) those that detonate near the end of front dwell and during the early stages of gun unlock; (3) those that detonate during the later stages of unlock and/or during the early stage of extraction; (4) those that detonate during extraction up to the point of unloading; (5) those that detonate after unloading or in the gun feeder (transfer) unit; and finally, (6) those that detonate in the feed system. The exact bounds of these categories varies with firing rate.

Since a Gatling gun is fired at different rates in various applications, any particular round will pass through the above stages at different times during the operating cycle of the gun.

Figure 1:
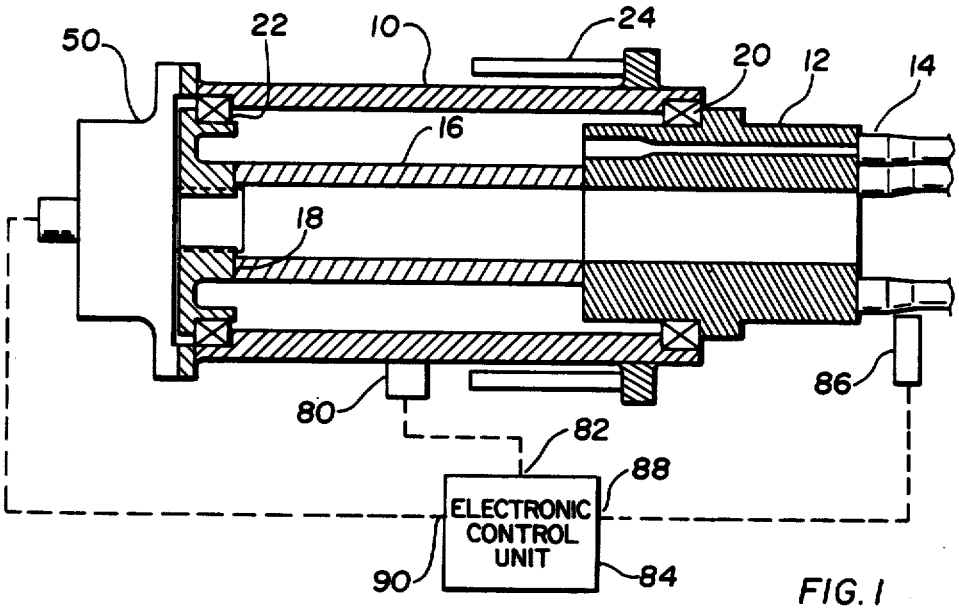
FIG. 1 is a longitudinal view of a Gatling gun, of the type shown, for example, in U.S. Pat. No. 4,342,253 issued to R. G. Kirkpatrick et al on Aug. 3, 1982, and provided with a control system embodying this invention.
Figure 2:
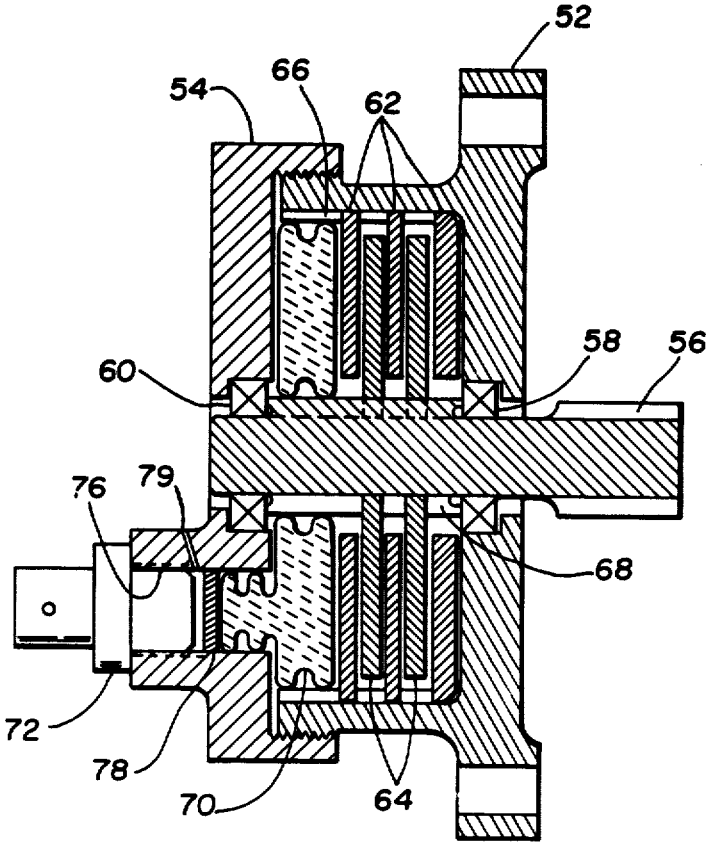
FIG. 2 is a detail view of the brake of FIG. 1.
Figure 6:
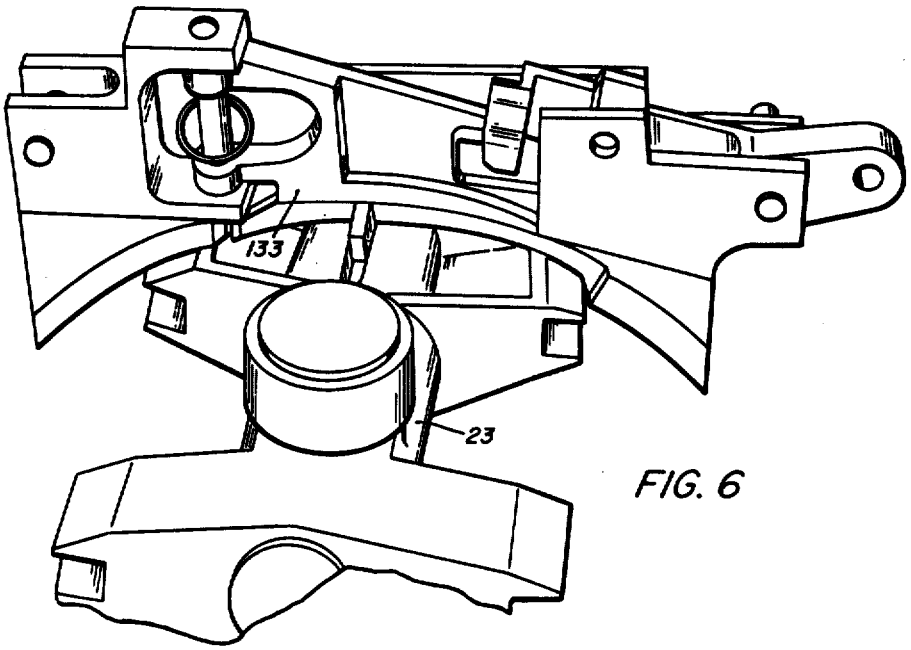
FIG. 6 is a detail view of an exemplary one of the plurality of gun bolts and the firing cam of the gun of FIG. 1, of the type shown, for example, in U.S. Pat. No. 4,274,325 issued to R. R. Snyder et al on June 23, 1981.

As seen in FIG. 1, the Gatling gun includes a stationary gun housing 10, in which is journaled for rotation a rotor assembly comprising a breech rotor 12, a plurality of gun barrels 14, (for each of which there is a respective gun bolt) a track rotor 16, and an aft cover 18. The assembly is supported by a forward bearing 20 and an aft bearing 22 within the housing. A stationary cam in the housing engages each of the gun bolts 23 (shown in FIG. 6) and causes them to reciprocate fore and aft during each cycle of operation, while another stationary cam causes the heads of the bolts to rotate into lock and unlock during forward dwell. The housing is supported by a pair of recoil adapters 24 to the gun mount, as shown, for example, in U.S. Pat. No. 4,345,504 issued to R. G. Kirkpatrick et al on Aug. 24, 1982, which permit longitudinal movement of the housing in response to recoil forces. A brake assembly 50 is fixed to the aft end of the housing and is coupled to the rotor assembly.

The brake assembly 50 includes a brake housing 52 which is fixed to the gun housing 10 by suitable means such as bolts. A brake cover 54 is fixed to the housing 52 by suitable means, such as threads. A brake shaft 56 is journaled for rotation by a forward bearing 58 captured between opposed shoulders in the housing 52 and the shaft, and by an aft bearing 60 captured between opposed shoulders in the cover 54 and the shaft. A plurality of interleaved stator disks 62 and rotor disks 64 are disposed on the shaft within the housing 52. The stator disks are keyed onto splines 66 in the housing and the rotor disks are keyed onto splines 68 in the shaft. The disks are held closely together by a bellows 70 filled with a fluid, such as, for example, silicone. A holder 72 for a squib has an electrical connector and is secured, as by mutual threads, into a bore 76 in the cover 54. A pusher plate 78 is disposed between the squib and the bellows. A vent 79 is provided into the bore 76 to permit a dissipation of the gas pressure after the squib has fired and compressed the brake disks together.

A recoil detector 80 is fixed to or adjacent the housing to provide an output signal to a first input 82 of an electronic control unit 84 upon the initiation of longitudinal recoil movement of the housing 10.

A barrel angular position detector 86 is fixed adjacent the cluster of barrels to provide an output signal to a second input 88 of the control unit as each gun bolt rotates through its firing pin release (sear) position.

The control unit has an output terminal 90 to provide a fire signal, or brake activate signal, to the squib holder 72 under certain logical circumstances.

The squib is not to be fired if a recoil acceleration is detected within a predetermined period of time.

The squib is to be fired if:

(1) a round is present in the chamber; and (2) a predetermined period of time has expired since the firing pin of the gun bolt of that chamber rotated past its release position; and (3) the firing cam is in its "release the firing pin to fire" disposition; and (4) the trigger is in its "fire" disposition.

The foregoing assumes percussion fired ammunition. If electrically fired ammunition is used then the following should be substituted for condition (2) above:

a predetermined period of time has expired since the firing pin/contact of the gun bolt of that chamber rotated past its fire-volts contact position.

Figure 4:
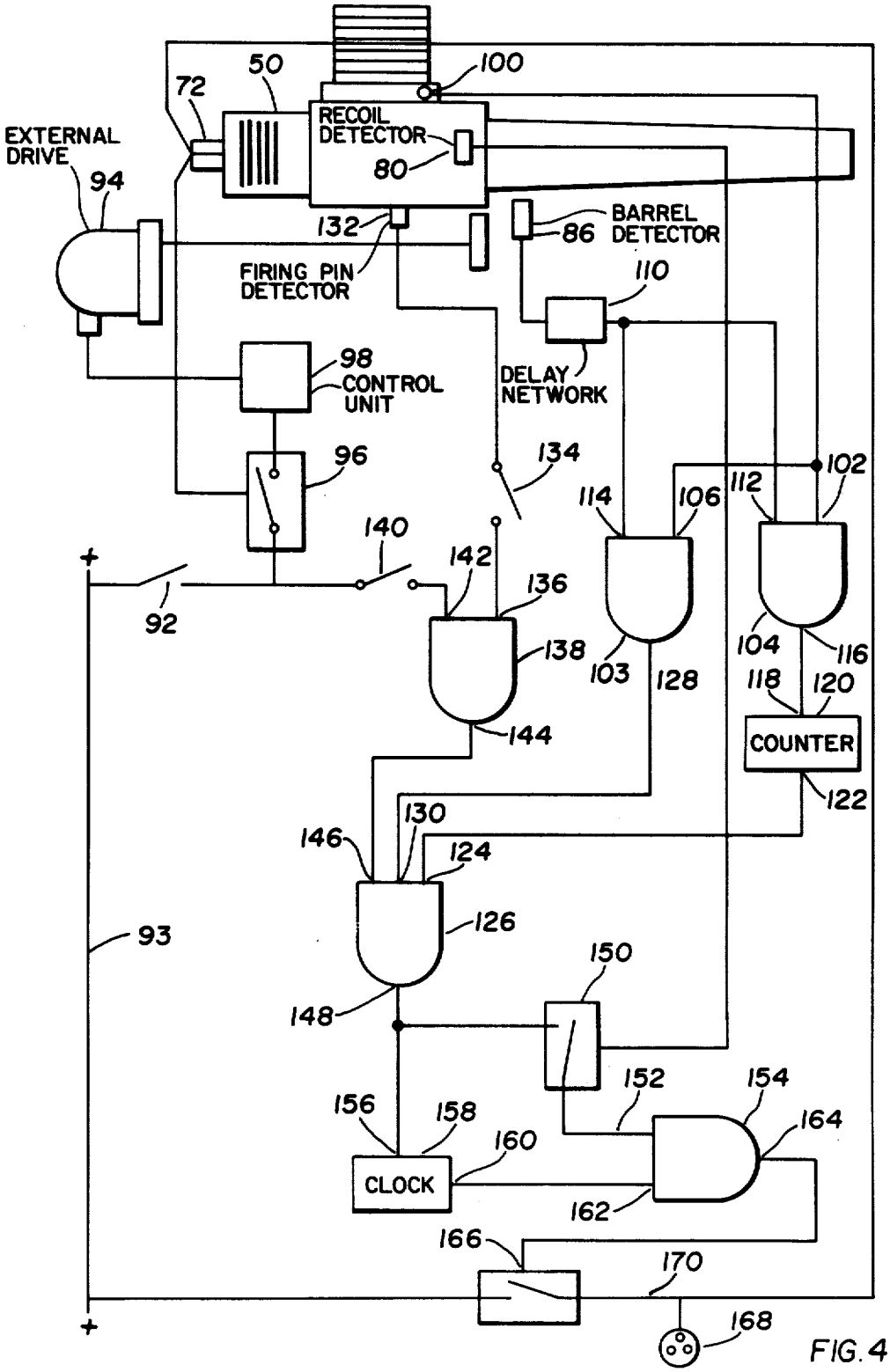
FIG. 4 is a diagram of the logic of the circuit.

Consider FIG. 4. In the conventional Gatling gun and ammunition handling system, having an external drive and reverse clearing, of the type shown, for example, in U.S. Pat. No. 3,766,823, issued Oct. 23, 1973 to L. R. Folsom et al, there are not any rounds in the gun prior to the trigger 92 being moved to its fire (closed) disposition. The trigger is connected to a fire voltage bus 93. This fire disposition energizes the external drive 94 via a normally closed relay 96 and a conventional control unit 98 to rotate the gun and to advance rounds from the ammunition handling system through the feeder and into the gun. A proximity detector 100 placed adjacent the hand off sprocket in the feeder which is a known number, e.g. x, of round pitches prior to the firing pin release disposition, will provide a signal pulse to first input 102 of an AND gate 104 and first input 106 of an AND gate 108 when a round passes through the sprocket. The signal pulse from barrel angular detector 86 is passed through a delay network 110 to provide a signal pulse to a second input 112 of the AND gate 104 and a second input 114 of the AND gate 103. The delay network serves to synchronize the arrival of the signal pulses from the detectors 86 and 100 to the AND gates 104 and 108. Alternatively, if appropriate, the delay network may be in the signal line from the detector 100. The AND gate 104 has an output 116 which provides a signal pulse to the input 118 of a counter 120 which provides an output signal pulse and latches on the count of x at its output 122 which is connected to a first input 124 of an AND gate 126. The AND gate 103 has an output 128 which provides a signal pulse to a second input 130 of the AND gate 126.

A detector 132 provides an output signal, when the firing cam 133 is in its "release the firing pin to fire" disposition, through a normally closed switch 134 to a first input 136 of an AND gate 138. The firing cam 133 may be of the type shown, for example, in U.S. Pat. No. 4,274,325 issued June 23, 1981 to R. R. Snyder. Switch 134 will be opened by a safing pin inserted into the firing cam to secure it on its non-firing disposition. When the trigger 92 is closed it provides a signal through a normally closed safety switch 140 to a second input 142 of the AND gate 138, which has an output 144 which provides a signal to a third input 146 of the AND gate 126. The AND gate 126 has an output 148 which provides an output signal each time the firing pin is released on a round in a chamber.

The recoil detector 80 upon detecting the commencement of a recoil provides a signal to a normally closed relay 150 and opens relay for a predetermined period, e.g. 10 milliseconds. When the relay 150 is closed it couples the output 148 of the AND gate 126 to an input 152 of an AND gate 154.

The output 148 of the AND gate 126 is also connected to the input 156 of a clock 158 which after a selectable delay provides an output signal and latches at its output 160. For example, the clock may have a variable delay of 4 to 10 milliseconds which, for a particular application, is selected to provide an output signal after 5 milliseconds. This output signal is provided to a second input 162 of the AND gate 154. Thus, the AND gate 154 is disabled for the first 5 milliseconds after the firing pin has been released, but will provide an output signal at its output 164 for the next 5 milliseconds unless a recoil has been detected, and the relay 150 opened, prior to the expiration of the first 5 milliseconds. The output signal at output 164 is coupled to the input 166 of normally open relay 168, which when closed by a signal provides firing voltage, which is a brake operate signal, to the squib holder 72.

A pulse ratcheted indicator 168 may be connected to the squib firing conductor 170 to indicate the number of squibs which have been cumulatively fired. A pulse ratcheted squib holder having a plurality of squibs may be substituted for the squib connector 72 to provide a fresh squib a predetermined period after the previous squib has been fired.

Figure 3:
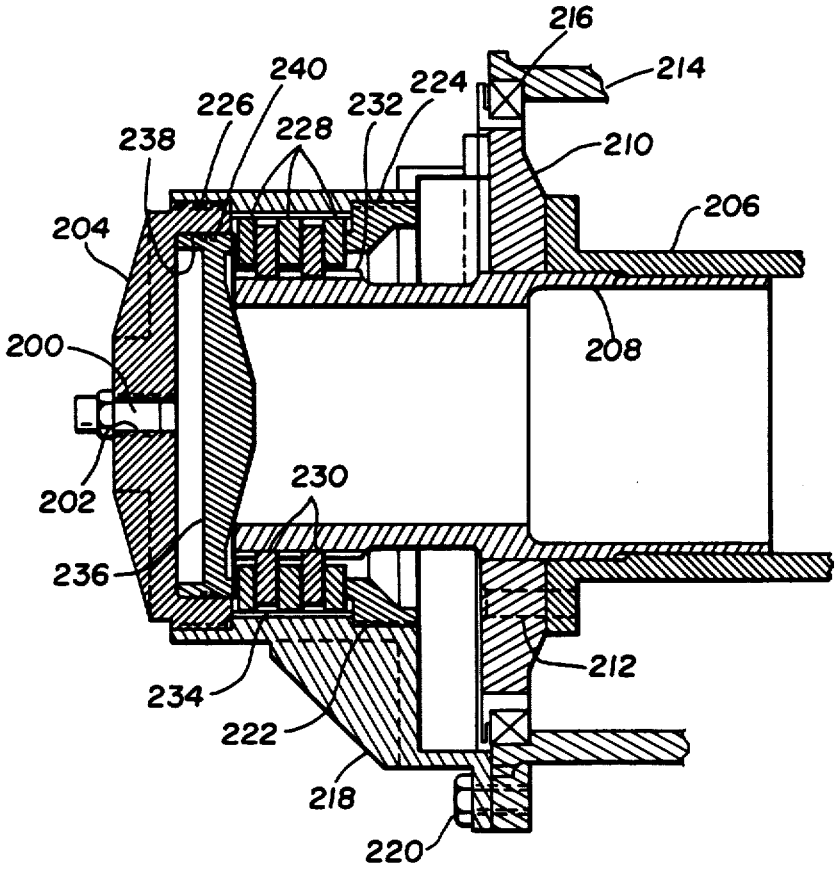
FIG. 3 is a longitudinal detail view of another embodiment of the invention.

FIG. 3 shows a brake having a single squib 200 threaded into a mounting bore 202 on a brake cover 204 and coaxial with the axis of rotation of the gun. The track rotor 206 is fixed to a brake hub 208, as by brazing, and is fixed to a gun back plate 210, as by bolts 212. The back plate is journaled for rotation in the gun housing 214 by an aft bearing 216. A brake housing 218 is fixed to the gun housing 214, as by bolts 220. A retainer ring 222 is fixed to the brake housing, as by mutual threading 224 and the cover 204 is fixed to the brake housing, as by mutual threading 226. A plurality of interleaved stator disks 228 and rotor disks 230 are disposed on the hub 208 within the housing 218. The stator disks 228 are keyed onto splines 234 in the housing and the rotor disks 230 are keyed onto splines 232 in the hub. A piston 236 is disposed in a cylinder 238 formed in the brake cover 204. The piston has annular seals 240. In the not-braking condition, the piston 236, the disks 228, 230 and the retainer ring 224, are closely spaced together, so that very litte travel of the piston is required to squeeze the disks together to provide quick braking action.

Figure 5:
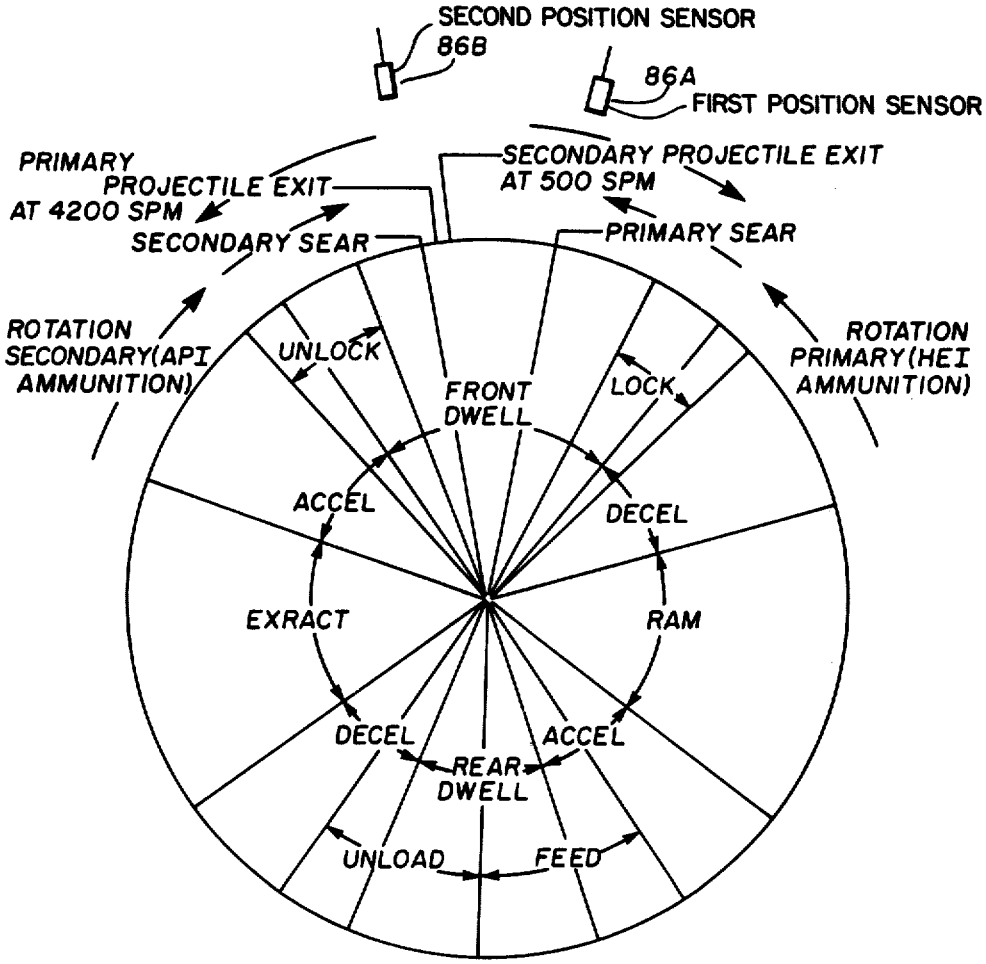
FIG. 5 is a firing cycle timing diagram for a dual rotation gun, of the type shown, for example, in U.S. Pat. No. 4,342,253.

FIG. 5 shows the firing cycle timing diagram for a dual rotation gun which is intended to rotate in a first direction to load and fire a primary type of ammunition, and to rotate in a second direction, opposite to said first direction, to reverse clear the primary ammunition; and to rotate in said second direction to load and fire a secondary type of ammunition, and to rotate in said first direction to reverse clear the secondary ammunition. If such a dual direction gun is utilized, a first position sensor **86*a* is used to detect firing pin release when firing in the first direction, and a second position sensor 86*b*** is used to detect firing pin release when firing in the second direction.

I claim:

1. In a Gatling gun system having:

a stationary housing;

a rotor assembly, journaled for rotation about a longitudinal axis within said housing, having a plurality of gun barrels with respective chambers disposed in an annular row about said longitudinal axis, a like plurality of gun bolts, each aligned with a respective gun barrel, a fire cam for causing each gun bolt to fire a round in its respective aligned chamber at a particular angular displacement during the rotation of said rotor assembly;

the improvement of:

normally inactive brake means coupled to and between said housing and said rotor assembly;

means to activate said brake means to rapidly halt the rotation of said rotor assembly relative to said housing;

first means to provide a first signal upon the passage of each gun bolt past said particular angular displacement;

second means to provide a second signal upon the commencement of recoil of said rotor assembly; and control means for receiving said first and second signals and for providing a brake operate signal to said means to activate said brake means if said first signal is not followed by a second signal within a predetermined period of time.

2. In a Gatling gun system according to claim 1, the further improvement of:

third means to provide, in synchronism with the provision of said first signal, a third signal upon the presence of a round of ammunition in the respective chamber;

said control means also for receiving said third signal and for providing a brake operate signal to said means to actuate said brake means if both said first and third signals are provided and not followed by a second signal within a predetermined period of time.

3. In a Gatling gun system according to claim 2, the further improvement of:

fourth means to provide a fourth signal upon the fire cam being not operable to cause a gun bolt to fire;

said control means also for receiving said fourth signal and for not providing a brake operate signal if said fourth signal is provided.

4. In a Gatling gun system according to claim 1, the further improvement of:

said brake means includes a plurality of first disk pads fixed to said housing and interleaved therewith a second plurality of second disk pads fixed to said rotor assembly, and a piston for compressing said first and second pads together.

5. In a Gatling gun system according to claim 4, the further improvement of:

said means to activate said brake means includes a gas generating squib which upon receiving said brake operate signal generates gas to operate said piston.

* * * * *